United States Patent [19]

Katrynuik

[11] Patent Number: 5,007,203

[45] Date of Patent: Apr. 16, 1991

[54] REPLACEABLE WEATHER SEAL

[76] Inventor: Matthew M. Katrynuik, 958 St. Matthews Avenue, Winnipeg, Manitoba, Canada, R3G 0J6

[21] Appl. No.: 493,623

[22] Filed: Mar. 15, 1990

[51] Int. Cl.[5] ..... E06B 7/16

[52] U.S. Cl. ..... 49/493; 49/482; 49/491; 49/496

[58] Field of Search ..... 49/493, 482, 491, 489, 49/485, 496, 475

[56] References Cited

U.S. PATENT DOCUMENTS

| | | | |
|---|---|---|---|
| 2,400,470 | 5/1946 | Spraragen | 49/493 |
| 3,167,827 | 2/1965 | Alley et al. | 49/482 X |
| 3,221,375 | 12/1965 | Lewis et al. | 49/493 X |
| 3,309,817 | 3/1967 | Fisher | 49/493 X |
| 3,796,006 | 3/1974 | Dixon | 49/493 |
| 3,987,587 | 10/1976 | Miller | 49/493 |
| 4,119,325 | 10/1978 | Oakley et al. | 49/493 X |
| 4,328,273 | 5/1982 | Yackiw | 49/496 X |
| 4,535,564 | 8/1985 | Yackiw | 49/489 |

*Primary Examiner*—Philip C. Kannan
*Attorney, Agent, or Firm*—Norman B. Rainer

[57] ABSTRACT

The invention is a replaceable weather seal suitable for attaching to a frame with screws, which is comprised of two parts. The first part is a carrier, a portion of the entire length of which is substantially flat and has apertures suitable for screws to pass through spaced along its length. The other portion of the entire length of the carrier is "U"-shaped and has a U-shaped opening that runs along the outside of the entire length of the carrier. The second part is a weather sealing member, a portion of which, along its entire length is substantially flat. The weather sealing member is comprised of a foam interior which is covered by a water and tear resistant material; and a substantially non-deformable insert which is situated inside the water and tear resistant material at the bottom of the substantially flat portion of the entire length of the weather sealing member. The substantially flat portion of the weather sealing member holdingly fits within the "U"-shaped portion of the carrier, and may be inserted into the carrier through the "U"-shaped opening. Should the weather sealing member ever become worn, all that must be done to replace it, is to pull it out of the carrier and insert a new weather sealing member into the carrier, while the carrier remains on the door frame.

7 Claims, 3 Drawing Sheets

FIG. 1
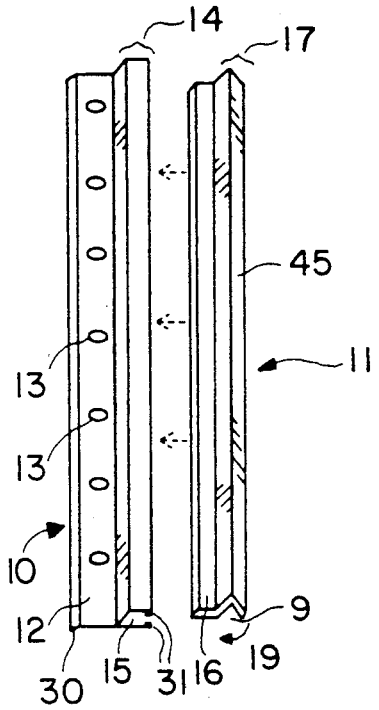
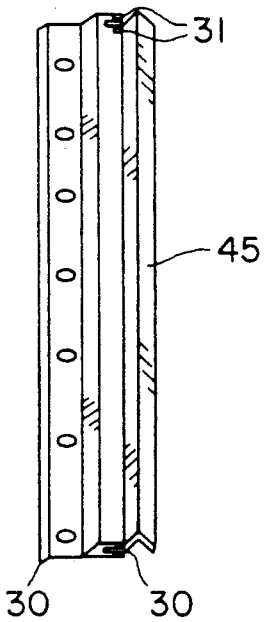
FIG. 2
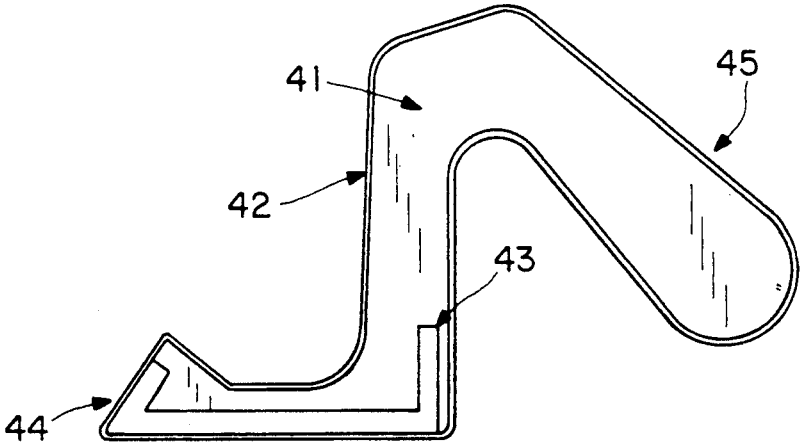
FIG. 3

REPLACEABLE WEATHER SEAL

BACKGROUND OF THE INVENTION

1. Field of the Invention

The present invention relates to weather seals, and more particularly to weather seals for sealing a door or swing-opening window within its frame, such that wind and rain is substantially prevented form entering between the door or swing-opening window and its frame.

2. Description of Related Art

There are many types of weather seals, some of which are designed to seal a door within its frame. Weather stripping is one of the least expensive of the weather seals, it typically consists of a length of foam which has an adhesive backing. Weather stripping is commonly used in door frames. Disadvantages to weather stripping are that it does not have a multi-year life span, and that the worn portions must be removed from the door frame before new weather stripping can be put on; which can sometimes involve having to scrape the adhesive backing off the door frame. The foam insulating portion of the weather stripping previously described is commonly made of a low density foam which is often narrow and relatively thin. A disadvantage to using low density foam which is narrow and thin is that slight bowing in the door or frame, or slight mis-alignments, can result in weather leaks between the door and weather stripping.

Two part weather seals have also been invented, which are made up of a support or carrying member and a sealing member. A typical previously known two part weather seal requires the sealing member to be inserted into the carrying member from either the top or bottom end of the carrying member. The disadvantage to having the end insert the sealing member is that when the sealing member wears out, and must be replaced, the carrying member must be removed from the door frame in order for a new sealing member to be end inserted into the carrying member. Many of the previously invented two part weather seals also have some or all of the disadvantages that they are: expensive to make, or not adjustable on the door frame (hence cannot accommodate warped or bent frames or doors) or their carrying member and/or sealing member are very thick and unattractive.

SUMMARY OF THE INVENTION

The present invention is a replaceable weather seal suitable for attaching to a frame with screws, which is comprised of: a carrier, a portion of which, along the entire length of the carrier, is substantially flat with apertures spaced along it's length, the remaining portion of the entire length of the carrier is "U"-shaped; wherein the opening of the "U"-shaped portion is on the outside of the entire length of the carrier; and a weather sealing member, a portion of which, along the entire length of the weather sealing member, is substantially flat; wherein the weather sealing member is comprised of a foam interior covered by a water and tear resistant material, and a substantially non-deformable insert which is situated inside the water and tear resistant material at the bottom of the substantially flat portion of the entire length of the weather sealing member; and wherein the substantially flat portion along the entire length of the weather sealing member is of a size to holdingly fit within the "U"-shaped portion of the carrier.

To use the invention to weather seal a door frame the carrier with the weather sealing member in it is pressed tightly against the inside edge of the closed door, in its sealing position, the aperture locations are then marked along the door frame, the replaceable weather seal is then removed and screw holes drilled in the marked locations on the door frame, the carrier is then screwed onto the door frame and the weather sealing member inserted into the carrier. The weather sealing member is inserted into the carrier by pressing the side of the substantially flat portion of the entire length of the weather sealing member into the opening of the "U"-shaped portion of the carrier.

In the preferred embodiment the outside edge of the substantially flat portion of the entire length of the weather sealing member is raised. In the preferred embodiment, the portion of the entire length of the weather sealing member that was not substantially flat, extends vertically up from the inside end of the flat portion and then curves downwardly. In the preferred embodiment the apertures along the substantially flat portion of the entire length of the carrier are elongated to allow for some lateral movement of the carrier, even after the screw holes have been drilled, The ability of the carrier to move laterally allows for easier alignment of the replaceaple weather seal with the edge of the door. Should the weather sealing member ever become worn, all you have to do to replace it, is pull it out of the carrier and insert a new weather sealing member into the carrier, while the carrier remains screwed into the door frame.

Those skilled in the art will see that the replaceable weather seal of the invention could easily also be used on window frames, or anything similar to a window or door frame where weather sealing is required. Those skilled in the art will also readily see that the installation of the replaceable weather seal of the invention on window frames and the like would be carried out in the same fashion as previously described for door frames.

The tear and water resistant covering will help keep the weather insulating foam portion of the weather sealing member from becoming worn or torn. The shape of the weather sealing member in the preferred embodiment provides additional resistance against the entry of weather especially on doors that have become bowed.

One advantage to the invention can therefore be seen to be that once it has been installed no re-measuring or re-installation procedures should have to be undertaken for the life of the door or window, etc. The reason for the foregoing advantage is that the carrier should not wear out, and should the weather sealing member wear out, only it need be replaced, and that can be done by simply pulling out the old one and inserting a new one. A second advantage is that the replaceable weather seal of the invention can be produced to be relatively small, therefore when installed it will be unobtrusive and hence only minimally effect the aesthetics of the door or window it is installed to weather seal. A third advantage is that it can be produced and sold at a relatively low cost for a two part weather seal. A forth advantage is that it provides a very effective weather seal.

BRIEF DESCRIPTION OF THE DRAWINGS

FIG. 1 is a prespective view of a preferred embodiment of the invention showing the carrier and weather sealing member apart;

FIG. 2 is a prespective view of a preferred embodiment of the invention showing the weather sealing member in the carrier;

FIG. 3 is a cross section of a preferred embodiment of the weather sealing member;

DESCRIPTION OF THE PREFERRED EMBODIMENT

Figure 4:
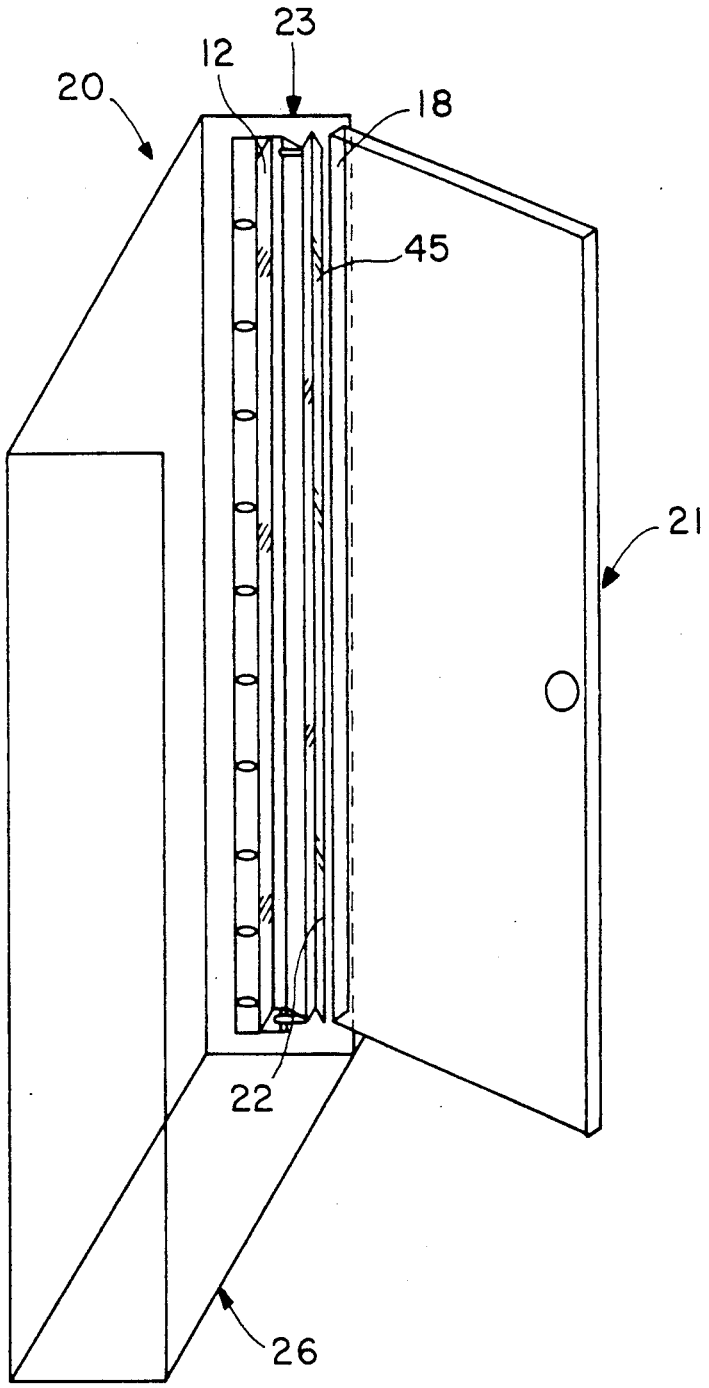
FIG. 4 is a prespective view of a preferred embodiment of the invention attached to the back side of a door frame, with the the door open.

The preferred embodiment of a replaceable weather seal illustrted in FIG. 1 is comprised of a carrier 10 and a weather sealing member 11.

The carrier is made of plastic. Half of the carrier, along the entire length of the carrier, as at 12, is substantially flat with flat-oval shaped apertures 13 evenly spaced along it. The other half of the carrier, along the entire length of the carrier, as at 14, is "U"-shaped. The opening of the "U"-shaped portion 14 runs along one side of the entire length of the carrier and defines a "U"-shaped open side 15, of the carrier. A resiliently flexible downward curved lip 30 is formed along the entire length of the outside of the substantially flat half of the carrier and another resiliently flexible downward curved lip 30 is formed along the entire length of the bottom outside side of the "U"-shaped half of the carrier. In the preferred embodiment the lips 30 are made of plastic and extend downward to a slight extent and are flexible enough such that when the carrier is screwed into a frame they flatten out and do not raise the bottom of the carrier away from the frame. Ribs 31, are formed along the entire length of the top and bottom inside edges of the opening of the "U"-shaped portion 14. The ribs 31 are formed perpendicular with the edge they are on, such that they extend into the "U"-shaped opening. The ribs 31, accordingly, face each other and make the opening of the "U"-shaped portion 14 narrower than the inside of the "U"-shaped portion. The ribs 31, narrow the opening to such an extent that they must be pushed slightly apart when the weather sealing member 11 is inserted, and to such an extent that after the weather sealing member has been inserted and they come back together, they press against the inserted portion of the weather sealing member with which they come into contact.

Half of the entire length of the weather sealing member of the preferred embodiment, as at 16, is substantially flat, except near its outside side 44, as illustrated in FIG. 3, which is raised and appears triangular in cross section. A section portion, as at 17, of the entire length of the weather sealing member, extends vertically up from the inside side of the substantially flat portion and then curves downwardly at at 45. The interior of the weather sealing member of the preferred embodiment, as illustrate in FIG. 3, is comprised of a solid foam substance 41, preferably urethane foam, and a non-deformable insert 43, which is preferably made of polypropylene. The interior foam and insert is covered with a water and tear resistant material 42, preferably a polyethyle film. In the preferred embodiment the non-deformable insert has a flat mid-section with a perpendicular upward extending back portion and a front portion the end of which is angled upwardly and backwardly to form a half-arrow at the head of the insert. The non-deformable insert 43 is situated at the bottom of the substantially flat portion of the weather sealing member such that the half-arrow extends up into the raised portion 44 and the perpendicular upward extending back portion extends up into the portion of the weather sealing member that extends up from the inside side of the substantially flat portion. The substantially flat portion of the weather sealing member is of a size to holdingly fit within the "U"-shaped portion of the carrier.

To attach the preferred embodiment to a door frame one would, with the door closed, take the carrier with the weather sealing member in it and press it tightly against the inside edge of the door in its sealing position, then mark, along the door frame, the locations to drill the screw holes, then remove the replaceable weather seal, drill the holes and screw the carrier onto the door frame. The flat-oval shaped apertures will allow for some lateral movement of the carrier, even after the screw holes have been drilled, thus allowing for easier alignment fo the replaceable weather seal with the edge of the door. Should the weather sealing member ever become worn, all you have to do to replace it, is pull it out of the carrier and insert a new weather sealing member into the carrier, while the carrier remains screwed into the door frame. Similar installation could be done on window frames, and anywhere the replaceable weather seal can be used.

The resiliently flexible downward curved lips 30 will pressingly contour to the face of the door frame, thereby to a large degree preventing any weather from entering between the carrier bottom and the door frame.

The tear and water resistant covering 42 will help keep the weather insulating foam 41 from becoming worn or torn. Those portions of the downwardly curving portion of the weather sealing member which the door edge presses against the door is closed, will be pressed in against the portion of the weather sealing member that extends up from the inside side of the substantially flat portion. Accordingly, if the door edge is straight the downward curving portion of the entire length of the weather sealing member will be pressed in against the portion of the weather sealing member that extends up from the inside side of the substantially flat portion. Alternatively, if the door is slightly bowed or the frame is slightly bowed, then those portions of the replaceable weather seal that come in contact with the bowed portions of the door or frame will not have the downwardly curving portion of the weather sealing member pressed as tightly in against the portion of the weather sealing member that extends up from the inside side of the substantially flat portion, when the door is closed. However, because the downwardly curving portion of the weather sealing member will still be in contact with the door edge, when the door is closed, even where the door or frame is slightly bowed, it will still weather seal those portions. Therefore, the shape of the weather sealing member in its preferred embodiment provides reliable weather sealing even when the door or frame is slightlg bowed.

The half-arrow at the front of the insert 43 which must be forced out of the "U"-shaped open side 15 will prevent the weather sealing member from falling out of the carrier, and will substantially prevent the weather sealing member from sliding inside the "U"-shaped portion 14. The ribs 31, also, because of their pressing fit with the inserted portion of the weather sealing member with which they come into contact, assist in preventing the weather sealing member from sliding inside the "U"-shaped portion 14. The effect of preventing internal sliding of the weather sealing member is to help maintain the relative positioning of the door frame and the weather sealing member, which helps maintain the most effective weather sealing.

Of course, as previously stated, once the replaceable weather seal has been installed no re-measuring or re-installation procedures should have to be undertaken for the life of the door or window, etc. The reason for the foregoing advantage is that the carrier should not wear out, and should the weather sealing member wear out, only it need be replaced, and that can be done by simply pulling out the old one and inserting a new one. A second advantage is that the replaceable weather seal of the invention can be produced to be relatively small, therefore when installed it will be unobtrusive and hence only minimally effect the aesthetics of the door or window it is installed to weather seal. A third advantage is that it can be produced and sold at a relatively low cost for a two part weather seal. A forth advantage is that it provides a very effective weather seal.

Figure 5:
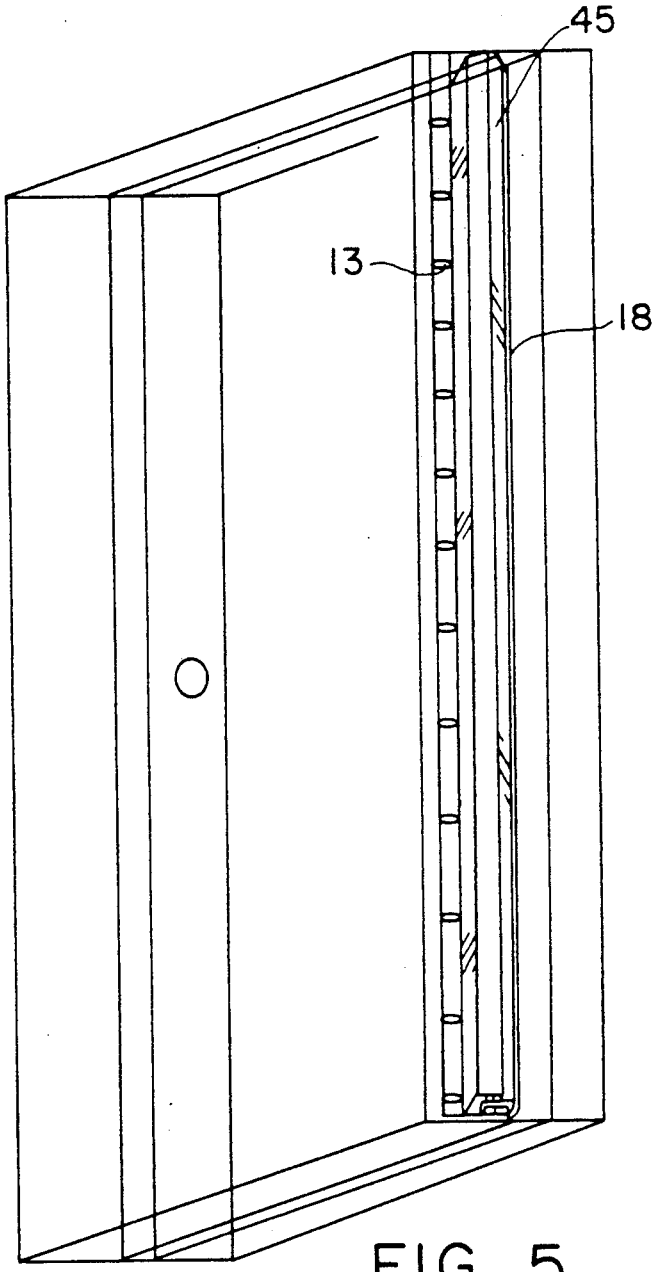
FIG. 5 is a prespective view of a preferred embodiment of the invention attached to the back side of a door frame, with the door closed.
Figure 6:
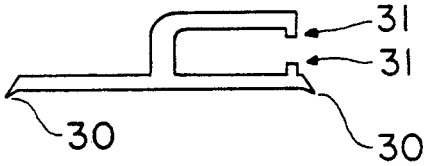
FIG. 6 is a cross section of a preferred embodiment of the carrier.

FIG. 4 illustrates the preferred embodiment of the invention attached to the back side 23 of a door frame, with the door open. When the door is closed, as in FIG. 5, the back inside edge 18 of the door will press the downwardly curving portion 45, of the weather sealing member, in against the portion of the weather sealing member that extends up from the inside side of the substantially flat portion.

Figure 7:
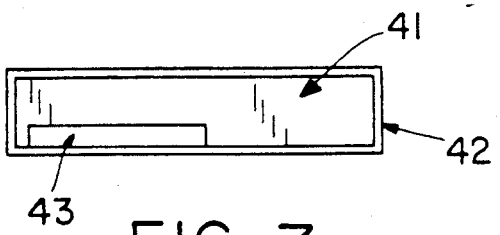
FIG. 7 is a cross section of a preferred embodiment of the weather sealing member.

Variations to the preferred embodiment will be readily apparent to those skilled in the art. For example, the resiliently flexible downward curved lips 30 need not be formed on the carrier. However, if lips such as at 30 are not employed, thie specific advantage to them, stated previously will be lost. The apertures as at 13 need not be flat-oval shaped, any suitable shape would suffice. The materials cited above for use in the preferred embodiment need not be used, any materials with similar properties could be used. For example instead of urethane for the foam, thermoplastic elastomer could be used, the water and tear resistant material, as at 42, need not be a polyethyle film it could be any one of many plastic impregnated materials, and the insert could be made of any suitable plastic product. The insert, also, need not be designed as stated in the preferred embodiment, any design that would assist in preventing the weather sealing member from sliding within the carrier will suffice. The ribs 31 need not be exactly perpendicular. The carrier, for example, could be constructed of aluminum, instead of plastic. The weather sealing member could be substantially flat along its entire length, as illustrated in FIG. 7. Further and other variations and alterations to the preferred embodiment are also possible and are within the scope of the claims.

I claim:

1. A replaceable weather seal suitable for attaching to a frame with screws, which is comprised of:

(a) foam, which along its entire length has a first portion that is thicker than its second portion, a second portion that is substantially flat, and a third portion that extends vertically up from the second portion and then curves downwardly, (b) an insert of approximately the same length as the foam, which insert is made of a non-deformable material, wherein a first portion and a third portion of the entire length of said insert is raised relative to its second portion, and its second portion is relatively flat;

(c) a cover that is made of a water and tear resistant material;

(d) wherein said insert is placed beneath the foam such that the first portion of the foam lies above the first portion of the insert, the second portion of the foam lies above the second portion of the insert and the vertically extending part of the third portion of the foam lies above the third portion of the insert, the cover is then sealingly attached around the foam and insert in such a manner that it closely conforms to the shape defined by the foam and insert, thereby forming a weather sealing member which is comprised of the covered foam and insert; and (e) a carrier that is substantially flat along a first portion of its entire length and approximately "U"-shaped along a second portion of its entire length, wherein the approximately "U"-shaped portion is constructed so that its outside side portion defines an open slit along the entire length of the carrier into which the first and second portions of the weather sealing member holdingly fit and within which the weather sealing member is held when the replaceable weather seal is in use.

2. A replaceable weather seal suitable for attaching to a frame with screws, which is comprised of:

(a) foam, which along its entire length has a first portion that is thicker than its second portion, a second portion that is substantially flat, and a third portion that extends vertically up from the second portion and then curves downwardly, (b) an insert of approximately the same length as the foam, which insert is made of a non-deformable material, wherein a first portion and a third portion of the entire length of said insert is raised relative to its second portion, and its second portion is relatively flat;

(c) a cover that is made of a water and tear resistant material;

(d) wherein said insert is placed beneath the foam such that the first portion of the foam lies above the first portion of the insert, the second portion of the foam lies above the second portion of the insert and the vertically extending part of the third portion of the foam lies above the third portion of the insert, the cover is then sealingly attached around the foam and insert in such a manner that it closely conforms to the shape defined by the foam and insert, thereby forming a weather sealing member which is comprised of the covered foam and insert;

(e) a carrier that is substantially flat along a first portion of its entire length and approximately "U"-shaped along a second portion of its entire length, wherein the approximately "U"-shaped portion is constructed so that its outside portion defines an open slit along the entire length of the carrier;

(f) ribs which are formed along the entire length of the top and bottom inside edges of the open slit of the carrier, which ribs extend approximately perpendicularly toward the inside of said open slip, thereby making the entrance to the open slit narrower than the interior of the open slit; and (g) wherein the first and second portions of the weather sealing member holdingly fit within the open slit and the weather sealing member is held within said open slit by said ribs when the replaceable weather seal is in use.

3. A replaceable weather seal suitable for attaching to a frame with screws, which is comprised of:

(a) foam, which along its entire length has a first portion that is thicker than its second portion, a second portion that is substantially flat, and a third portion that extends vertically up from the second portion and then curves downwardly, (b) an insert of approximately the same length as the foam, which insert is made of a non-deformable mateial, wherein a first portion and a third portion of the entire length of said insert is raised relative to its second portion, and its second portion is relatively flat;

(c) a cover that is made of a water and tear resistant material;

(d) wherein said insert is placed beneath the foam such that the first portion of the foam lies above the first portion of the insert, the second portion of the foam lies above the second portion of the insert and the vertically extending part of the third portion of the foam lies above the third portion of the insert, the cover is then sealingly attached around the foam and insert in such a manner that it closely conforms to the shape defined by the foam and insert, thereby forming a weather sealing member which is comprised of the covered foam and insert;

(e) a carrier that is substantially flat along a first portion of its entire length and approximately "U"-shaped along a second portion of its entire length, wherein the approximately "U"-shaped portion is constructed so that its outside portion defines an open slit along the entire length of the carrier;

(f) ribs which are formed along the entire length of the top and bottom inside edges of the open slit of the carrier, which ribs extend approximately perpendicularly toward the inside of said open slit, thereby making the entrance to the open slit narrower than the interior of the open slit;

(g) wherein the first and second portions of the weather sealing member holding fit within the open slit and the weather sealing member is held within said open slit by said ribs when the replaceable weather seal is in use; and (h) two resiliently flexible downward curved lips one of which is formed along the ouside side of the first portion of the carrier and the other of which is formed along the bottom outside side of the second portion of the carrier.

4. I claim a replaceable weather seal suitable for attaching to a frame with screws, as defined in claim 1, or 2 or 3, wherein the foam is urethane foam.

5. I claim a replaceable weather seal suitable for attaching to a frame with screws, as defined in claims 1, or 2, or 3, wherein the substantially non-deformable insert is made of polypropylene.

6. I claim a replaceable weather seal suitable for attaching to a frame with screws, as defined in claim 1, or 2, or 3, wherein the water and tear resistant material is made of a polyethyle film.

7. I claim a replaceable weather seal suitable for attaching to a frame with screws, as defined in claim 1, or 2, or 3, wherein the foam is urethane foam, the substantially non-deformable insert is made of polypropylene, and the water and tear resistant material is made of a polyethyle film.

* * * * *

UNITED STATES PATENT AND TRADEMARK OFFICE

CERTIFICATE OF CORRECTION

PATENT NO. : 5007203

DATED : 04/16/91

INVENTOR(S) : Matthew M. Katrynuik

It is certified that error appears in the above—identified patent and that said Letters Patent is hereby corrected as shown below:

Column 1, line 37, delete the first appearing "the", and substitute therefor --to--. Column 3, line 19, delete "a preferred", and substitute therefor --an alternate--; at line 36, after "outside", insert --side--; at line 63, delete the second appearing "section", and substitute therefor --second--. Column 4, line 30, change "fo" to read --of--. Column 5, line 45, change "thie" to read --the--. Column 6, line 67, after "outside" insert --side--. Column 8, line 3, after "outside", insert --side--.

Signed and Sealed this

Ninth Day of February, 1993

*Attest:*

STEPHEN G. KUNIN

*Attesting Officer*

*Acting Commissioner of Patents and Trademarks*